US009967682B2

(12) United States Patent
Eichfeld et al.

(10) Patent No.: US 9,967,682 B2
(45) Date of Patent: May 8, 2018

(54) BINAURAL HEARING ASSISTANCE OPERATION

(71) Applicant: Bose Corporation, Framingham, MA (US)

(72) Inventors: Jahn D. Eichfeld, Natick, MA (US); Kevin H. Franck, Concord, MA (US); Lisa A. Fitch, Needham, MA (US)

(73) Assignee: Bose Corporation, Framingham, MA (US)

( * ) Notice: Subject to any disclaimer, the term of this patent is extended or adjusted under 35 U.S.C. 154(b) by 157 days.

(21) Appl. No.: 14/988,161

(22) Filed: Jan. 5, 2016

(65) Prior Publication Data

US 2017/0195802 A1 Jul. 6, 2017

(51) Int. Cl.
*H04R 25/00* (2006.01)

(52) U.S. Cl.
CPC ..... *H04R 25/505* (2013.01); *H04R 25/305* (2013.01); *H04R 25/40* (2013.01); *H04R 25/552* (2013.01); *H04R 2225/43* (2013.01); *H04R 2460/01* (2013.01)

(58) Field of Classification Search
CPC ..... H04R 25/305; H04R 25/40; H04R 25/552
See application file for complete search history.

(56) References Cited

U.S. PATENT DOCUMENTS 4,010,340 A 3/1977 Palmer
4,955,729 A 9/1990 Marx
5,144,678 A 9/1992 Lenz
5,635,948 A 6/1997 Tonosaki
5,708,725 A 1/1998 Ito
6,118,878 A 9/2000 Jones
7,010,332 B1 3/2006 Irvin et al.
7,418,103 B2 8/2008 Sargaison
7,715,161 B2 5/2010 Grone
7,945,297 B2 5/2011 Philipp
(Continued)

FOREIGN PATENT DOCUMENTS

GB 2469796 A 3/2010

OTHER PUBLICATIONS

Srinivasan, S., "Low-bandwidth binaural beamforming.", Electronics Letters 44, No. 22 (2008): 1292-1294.*
(Continued)

*Primary Examiner* — Matthew Eason
*Assistant Examiner* — Taunya McCarty
(74) *Attorney, Agent, or Firm* — Brian M. Dingman; Dingman IP Law, PC

(57) ABSTRACT

A method of operating a hearing assistance system that includes a binaural hearing device with first and second earpieces, each earpiece adapted to be worn over, on or in one ear. Each earpiece has an electroacoustic transducer that converts an input electrical audio signal for the ear into sound, and at least one microphone that converts sound into an electrical microphone output signal. The hearing assistance system is adapted to process microphone output signals from both earpieces to create the electrical audio signals that are used to drive the transducers of both earpieces. A situation in which one of the earpieces is not over, on or in an ear is detected, and in response the processing of at least one of the microphone output signals that creates the audio signals is modified.

14 Claims, 3 Drawing Sheets

(56) References Cited

U.S. PATENT DOCUMENTS

| | | | | |
|---|---|---|---|---|
| 8,098,838 | B2 | 1/2012 | Lee et al. | |
| 8,165,307 | B2 | 4/2012 | Wong et al. | |
| 8,165,308 | B2 | 4/2012 | Norhammar et al. | |
| 8,238,567 | B2 | 8/2012 | Burge et al. | |
| 8,238,570 | B2 | 8/2012 | Johnson, Jr. et al. | |
| 8,243,946 | B2 | 8/2012 | Burge et al. | |
| 8,259,984 | B2 * | 9/2012 | van der Bilt | H04R 1/1041 381/334 |
| 8,335,312 | B2 | 12/2012 | Gerhardt et al. | |
| 8,498,439 | B2 | 7/2013 | Bae et al. | |
| 8,600,085 | B2 | 12/2013 | Chen et al. | |
| 8,630,425 | B2 | 1/2014 | Chang et al. | |
| 8,699,719 | B2 | 4/2014 | Johnson, Jr. et al. | |
| 2008/0031484 | A1 | 2/2008 | Danielson | |
| 2010/0020982 | A1 | 1/2010 | Brown et al. | |
| 2010/0020998 | A1 * | 1/2010 | Brown | H04R 1/1041 381/380 |
| 2011/0222701 | A1 | 9/2011 | Donaldson et al. | |
| 2011/0235817 | A1 | 9/2011 | Lin | |
| 2012/0008807 | A1 * | 1/2012 | Gran | H04R 25/407 381/313 |
| 2012/0086551 | A1 | 4/2012 | Lowe et al. | |
| 2012/0114154 | A1 | 5/2012 | Abrahamsson | |
| 2012/0189136 | A1 * | 7/2012 | Brown | H04R 1/1041 381/74 |
| 2012/0244812 | A1 | 9/2012 | Rosener | |
| 2013/0039507 | A1 | 2/2013 | Park et al. | |
| 2013/0249849 | A1 | 9/2013 | Wong et al. | |
| 2013/0336507 | A1 * | 12/2013 | Gran | H04R 25/407 381/313 |
| 2014/0146976 | A1 * | 5/2014 | Rundle | H04R 1/1083 381/71.6 |
| 2015/0230021 | A1 | 8/2015 | Donaldson et al. | |

OTHER PUBLICATIONS

The International Search Report and the Written Opinion of the International Searching Authority dated Mar. 20, 2017 for PCT Application No. PCT/US2017/012014.

* cited by examiner

BINAURAL HEARING ASSISTANCE OPERATION

BACKGROUND

This disclosure relates to a hearing assistance system.

Some binaural hearing assistance systems have two earbuds (or other types of earpieces that deliver sound to an ear), one for each ear. Each earpiece has one or more microphones. The microphones on both ears can be used together to increase the performance of the system, for example by binaural beamforming. Some users, however, prefer a single-ear device due to reduced stigma, ease of conveying social availability, having only a unilateral hearing loss, or other motivation. Users who prefer to use only one earpiece in a system where two earpieces are in some manner connected, be that physically with a wire or through wireless communication, may leave the other earpiece to rest against the neck or shoulder, or hidden under a shirt, or placed in a pocket, or placed in a storage case, or "parked" to neckware that is part of the system via a magnet, mechanical connection, or other means. Doing so, however, creates problems for binaural beamforming and other processing which utilize microphones on both sides of the head to create the output signal for each ear. Namely, the "dropped" earpiece and its microphones are no longer pointing in the "look" direction of the array, and they are no longer in the same plane or position relative to the other-side microphones. These two issues negatively impact performance of the array for the ear audio signal into the assisted ear. Additionally, microphones of the "dropped" earpiece may be in close contact to surrounding objects (e.g., shirt, necklace), and interference with those objects could cause significant and objectionable noise to be generated in the assisted ear. Further, when an earbud is removed from the ear there is increased acoustic coupling between the driver output and external microphone input, which can cause objectionable audible oscillation due to acoustic feedback. Other algorithms, such as binaural steady-state noise suppressors, may also perform in a sub-optimal manner.

SUMMARY

The above problems can be resolved or ameliorated by detecting when an earbud or another type of earpiece of a binaural hearing assistance system is not in, on or over an ear, and in response modifying the processing of the microphone signals that are involved in creating the audio signals. The detection drives a mode change in the beamforming (directional processing) and/or other system algorithms to improve performance for the single-ear assistance case. Improved performance in the single ear case could, for example, include changing the array design to a single-sided beamformer on the non-dropped side, changing the array design such that two-sided arraying is still used but only at frequencies in which the dropped microphones aid performance for the aided ear, modifying a binaural noise reduction algorithm to use data from the dropped ear in a different manner, turning off the output to the dropped earpiece driver so as to stop feedback oscillation, and turning off the microphone bias on the dropped earpiece, if the microphone is not needed, so as to decrease power consumption. Other benefits are possible.

All examples and features mentioned below can be combined in any technically possible way.

In one aspect, a method of operating a hearing assistance system that comprises a binaural hearing device that has first and second earpieces, each earpiece adapted to be worn over, on or in one ear, each earpiece comprising an electroacoustic transducer that converts an input electrical audio signal for the ear into sound, and at least one microphone that converts sound into an electrical microphone output signal, where the hearing assistance system is adapted to process microphone output signals from both earpieces to create the electrical audio signals that are used to drive the transducers of both earpieces, includes detecting when one of the first and second earpieces is not over, on or in an ear and in response modifying the processing of at least one of the microphone output signals that creates the audio signals.

Embodiments may include one of the following features, or any combination thereof. Modifying the processing of at least one of the microphone output signals that creates the audio signals may comprise processing only the microphone output signal from the other of the first and second earpieces to create the audio signal for the transducer of the other earpiece. Modifying the processing of at least one of the microphone output signals that creates the audio signals may comprise processing microphone output signals from both earpieces to create the electrical audio signals that are used to drive the transducers of both earpieces, but only up to a cutoff frequency. Modifying the processing of at least one of the microphone output signals that creates the audio signals may comprise modifying the processing of the microphone output signals from the earpiece that is not over, on or in an ear. In this case the method may further comprise maintaining the processing of the microphone output signals from the other earpiece. Modifying the processing of the microphone output signals from the earpiece that is not over, on or in an ear may comprise band limiting the microphone output signals from the earpiece that is not over, on or in an ear.

Embodiments may include one of the following features, or any combination thereof. The method may further comprise, in response to detecting when an earpiece is not over, on or in an ear, turning off or reducing the output level of the transducer of the earpiece that is not over, on or in an ear. The earpiece microphones may detect sound external to the earpieces. Modifying the processing of at least one of the microphone output signals that creates the audio signals may comprise turning off a microphone bias of a microphone of the earpiece that is not over, on or in an ear. Modifying the processing of at least one of the microphone output signals that creates the audio signals may comprise modifying a binaural steady-state noise reduction algorithm, which may comprise changing a configuration of internal parameters within the steady-state noise reduction algorithm.

In another aspect, a method of operating a hearing assistance system that comprises a binaural hearing device that has first and second earpieces, each earpiece adapted to be worn over, on or in one ear, each earpiece comprising an electroacoustic transducer that converts an input electrical audio signal for the ear into sound, and at least one microphone that converts sound into an electrical microphone output signal, where the hearing assistance system is adapted to process microphone output signals from both earpieces to create the electrical audio signals that are used to drive the transducers of both earpieces, includes detecting when one of the first and second earpieces is not over, on or in an ear and in response modifying a processing of the hearing assistance system that uses microphone output signals from both earpieces.

Embodiments may include one of the following features, or any combination thereof. Modifying a processing of the hearing assistance system that uses microphone output signals from both earpieces may comprise processing only the microphone output signal from the other of the first and second earpieces to create the audio signal for the transducer of the other earpiece. Modifying a processing of the hearing assistance system that uses microphone output signals from both earpieces may comprise processing microphone output signals from both earpieces to create the electrical audio signals that are used to drive the transducers of both earpieces, but only up to a cutoff frequency. Modifying a processing of the hearing assistance system that uses microphone output signals from both earpieces may comprise modifying the processing of the microphone output signals from the earpiece that is not over, on or in an ear while maintaining the processing of the microphone output signals from the other earpiece. Modifying the processing of the microphone output signals from the earpiece that is not over, on or in an ear may comprise band limiting the microphone output signals from the earpiece that is not over, on or in an ear.

Embodiments may include one of the following features, or any combination thereof. The method may further comprise, in response to detecting when an earpiece is not over, on or in an ear, turning off or reducing the output level of the transducer of the earpiece that is not over, on or in an ear. Modifying a processing of the hearing assistance system that uses microphone output signals from both earpieces may comprise changing a configuration of internal parameters within a binaural steady-state noise reduction algorithm.

DETAILED DESCRIPTION

Binaural hearing assistance devices have two earpieces, one for each ear. Some such devices use binaural microphone algorithms such as beamforming to improve performance. Binaural microphone algorithms are discussed in U.S. patent application Ser. No. 14/618,889, entitled "Conversation Assistance System," the disclosure of which is incorporated herein by reference. At times when only one earpiece is in an ear the input to binaural microphone algorithms (e.g., beamforming for directional processing) changes, since the microphones of the earpiece that is not in an ear are no longer pointing the same direction as the others (e.g., in the look direction of a binaural microphone array), and they are no longer in the same plane or position relative to the microphones of the earpiece that is in an ear. Any processing that uses microphones from both sides for the earpiece that is in an ear suffers as a result.

A binaural hearing assistance system with two earpieces can be operated so as to lessen the impacts associated with single ear operation. In part, this result is accomplished by, in response to detecting when one of the earpieces is not over, on or in an ear, modifying the processing of at least one of the microphone output signals that creates the audio signals. For example, the system can be modified so that only the microphone output signals from the earpiece in an ear are used to create the audio signal for the transducer of the earpiece that is in an ear. Or, the microphones from both earpieces can be used, but only up to a cutoff frequency. Another option is to modify the processing of the microphone output signals from the dropped earpiece such as by band-limiting them. Oscillation can be reduced or eliminated by either reducing the output level or turning off the transducer of the dropped earpiece that is not over, on or in an ear.

There are many ways by which to detect when an earpiece is not on, over or in an ear, i.e., it has been "dropped." Non-limiting examples include earpiece parking detectors that detect proximity of a parked earpiece to a charging case or neckware such as with a hall effect sensor, switch-based sensing triggered by mechanical capture or electrical contact of the parked earpiece with a charging case or neckware, and acoustic-based sensing of the earpiece no longer placed in the ear, to name a few. However, this disclosure is not limited by the manner in which a dropped earpiece is detected. Once a dropped earpiece has been detected, the system enables one or more changes to its operation that will reduce the negative effects of the dropped earpiece. System changes can be reversed when the dropped earpiece is placed back in, on or over an ear.

Figure 1:
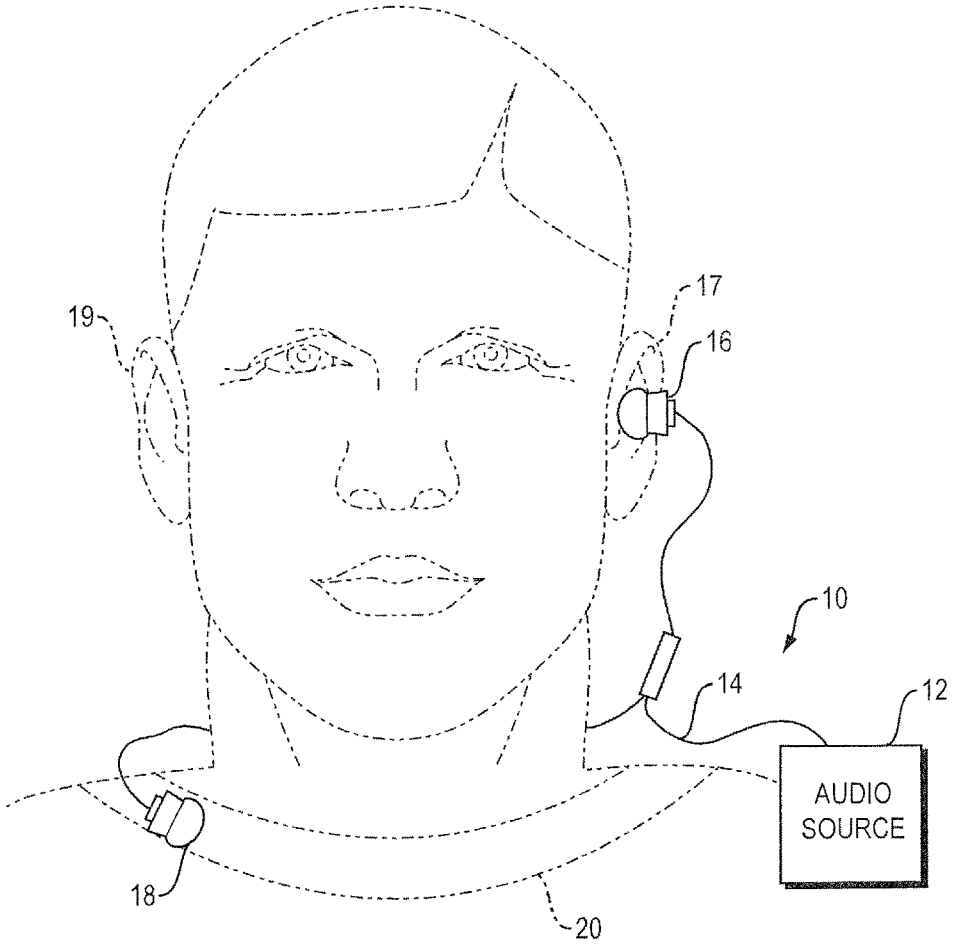
FIG. 1 is schematic diagram of a person using a binaural hearing assistance system.

Binaural hearing assistance system 10, FIG. 1, includes an audio source 12 that is operatively connected e.g., with wire 14, or wirelessly (for example using Bluetooth technology) to left earpiece 16 that is designed to be used in, on or over left ear 17, and right earpiece 18 that is designed to be used in, on or over right ear 19. In this non-limiting example earpiece 18 (which is illustrated as an earbud) has been removed from ear 19 and has been coupled ("parked") to neckwear 20 that is designed to hold an earpiece that is not in use. Neckwear 20 may include some mechanism or device that detects a dropped earpiece (such as but not limited to the mechanism used in the "Tone"™ line of wireless headsets available from LG Electronics USA), or as described above system 10 may include or be used with another means of detecting when an earpiece is not in, on or over an ear. Detection of a dropped earpiece drives a mode change in the system such as alternate beamforming modes and other algorithm modes or tunings to improve the performance of the system.

Figure 2:
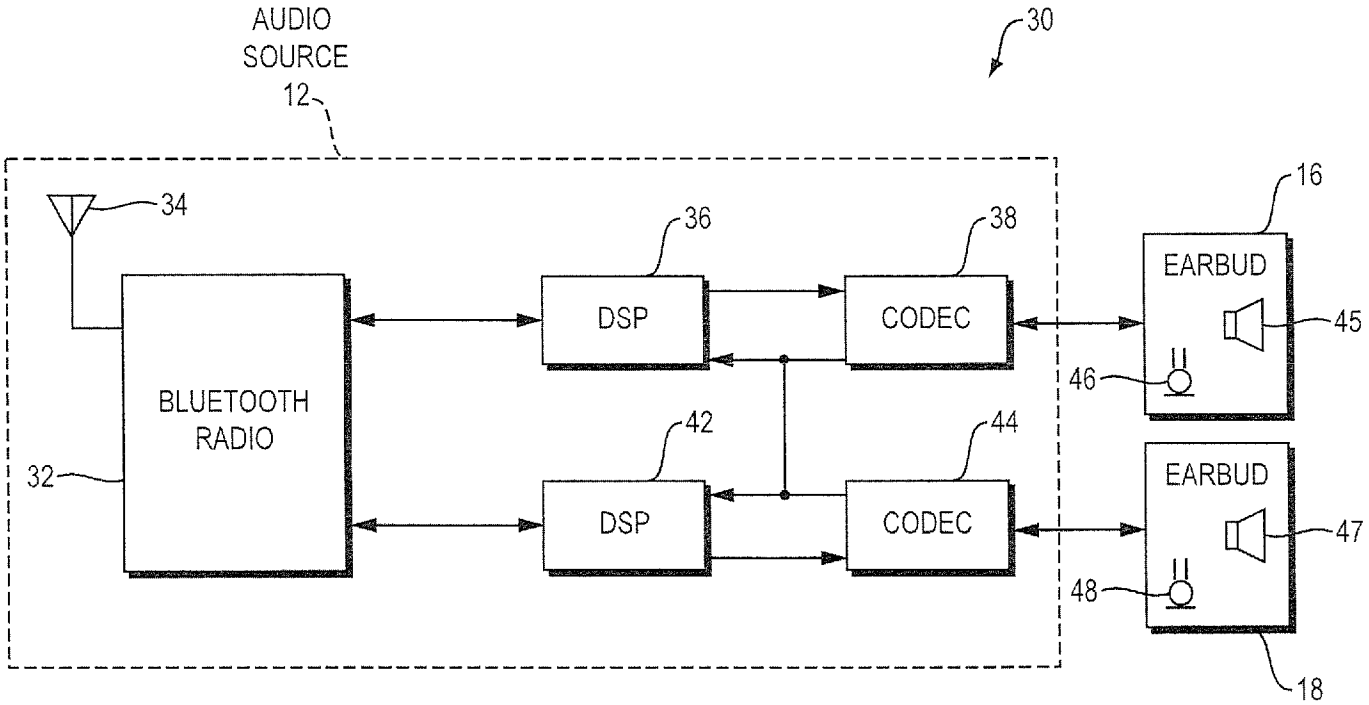
FIG. 2 is a schematic block diagram of a binaural hearing assistance system.

The electrical and electronic components of an exemplary binaural hearing assistance system 30 are schematically depicted in FIG. 2. Audio source 12 in this case includes Bluetooth radio 32 that has antenna 34. Audio source signals are provided to left and right digital signal processors (DSPs) 36 and 42, whose digital outputs are provided to left and right codecs 38 and 44. The resulting analog audio signals are provided to left and right earpieces (earbuds) 16 and 18, which have drivers 45 and 47 and microphone(s) 46 and 48, respectively. In some cases, the microphones alone are used to provide signals for output, perhaps processed by DSPs 36 and 42, i.e., like a conventional hearing aid, and no additional source is provided.

Figure 3:
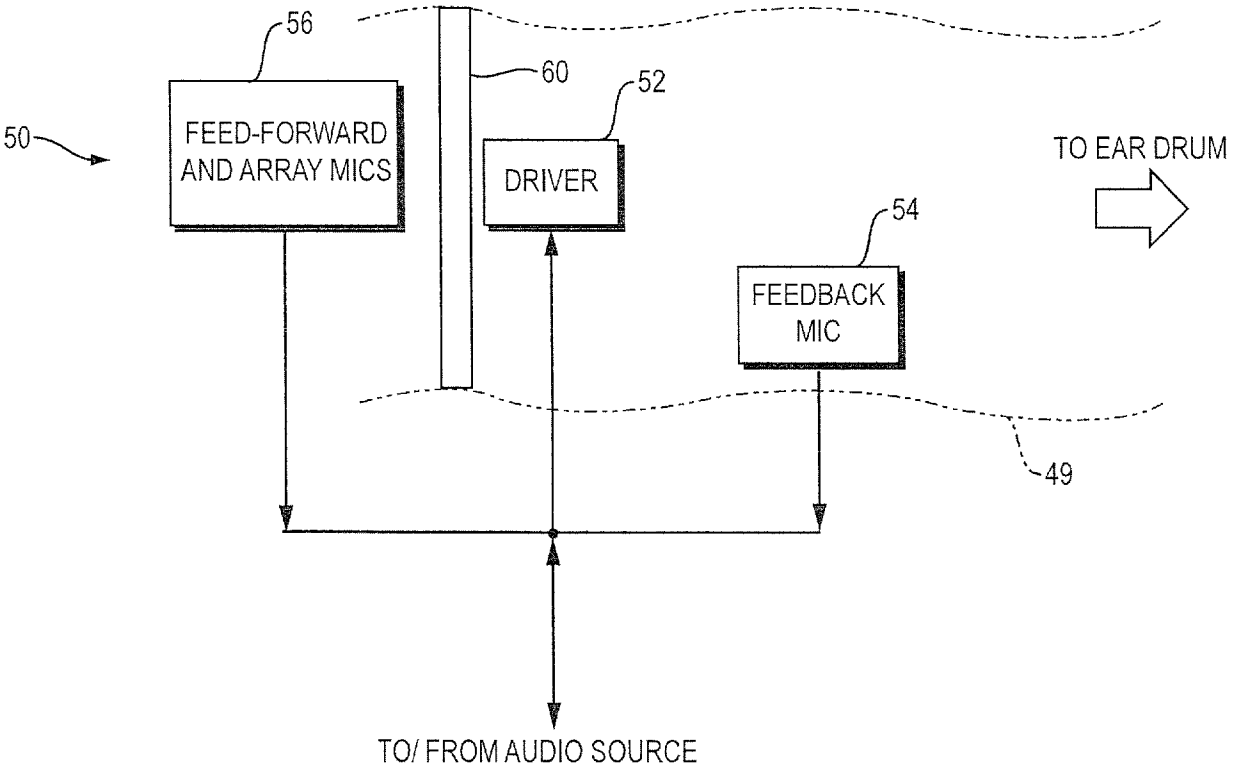
FIG. 3 is a schematic block diagram of an earbud for a binaural hearing assistance system.

An exemplary earbud 50 is shown in highly schematic block diagram form in FIG. 3. Earbud 50 is held in ear canal 49. Effective acoustic baffle 60 separates the outside environment from driver 52 and feedback microphone 54, which is used for feedback-based active noise reduction. Acoustic baffle 60 (shown schematically in FIG. 3) is typically effectively created by the combination of an ear tip, transducer, and mechanical enclosure combining those elements. Feed forward and array microphones 56 are used for feed-forward active noise cancellation and can be placed at the ear, proximate to the ear in the concha, or proximate, ideally above, the pinna. Combinations of feed forward and array microphones 56 are also used for environmental sound detection including as inputs to directional processing, dynamic range compression, and other hearing-related algorithms.

The components of the present binaural hearing assistance system are known in the art. The system is operated in accordance with the present disclosure so as to lessen the impacts associated with single-ear operation. These operational advantages are mostly accomplished via DSPs 36 and 42 (FIG. 2), which can be operated in a manner such that when a dropped earpiece is detected (e.g., using another component such as a switch (not shown) that is part of source 12, or using signals received by source 12 from one or more earpiece microphones), the processing of the output signals of one or more of microphones 54 and 56 that are used to create the audio signals that are provided to one or both of earpieces 16 and 18, is modified. In some cases the DSPs are controlled by a microprocessor (not shown).

In one example, the DSP operation can be modified for single-ear use so that the system operates as a single-sided beamformer on the non-dropped side, which can be accomplished by using only the microphone output signals from the earpiece in use (i.e., the earpiece that is located in, on or over an ear) to create the audio signal for the transducer of that earpiece. In another example the microphones from both earpieces can be used to create both audio signals (i.e., binaural beamforming operation remains), but only up to a cutoff frequency. The cutoff frequency can be selected such that the microphones of the dropped earpiece aid performance for the non-dropped earpiece. As one non-limiting example a cutoff frequency could be around 500 Hz; low frequencies that are still used in binaural beamforming in this case are helpful for providing location cues even though the microphones of the earpiece that is not in an ear are no longer pointing in the look direction of the microphone array, and they are no longer in the same plane or position relative to the microphones of the earpiece that is in an ear.

In another example of modified single-ear operation the processing of the microphone output signals from the dropped earpiece is modified in another way, such as by band limiting (or eliminating) the signals from the microphones of the dropped earpiece. Such modification could be applied to a binaural steady-state noise reduction algorithm, for example. In this example, configuration of internal parameters within the steady-state noise reduction algorithm could also be changed. In cases where microphone(s) are not used, the microphone bias (for microphones that need it) can be turned off, to reduce power consumption.

When acoustic baffle 60 no longer sufficiently decouples microphones 56 from driver 52, a potential feedback loop is created, by which the system can oscillate and create audible feedback signals. Such feedback signals can be reduced in amplitude (e.g., such that they are no longer audible to a person) or eliminated by either reducing the output level until the microphone no longer detects it and oscillation stops, or turning off the driver when the earpiece is dropped. Another approach would be to notch-filter the microphone around the frequency of the oscillation.

Elements of figures are shown and described as discrete elements in a block diagram. These may be implemented as one or more of analog circuitry or digital circuitry. Alternatively, or additionally, they may be implemented with one or more microprocessors executing software instructions. The software instructions can include digital signal processing instructions. Operations may be performed by analog circuitry or by a microprocessor executing software that performs the equivalent of the analog operation. Signal lines may be implemented as discrete analog or digital signal lines, as a discrete digital signal line with appropriate signal processing that is able to process separate signals, and/or as elements of a wireless communication system.

When processes are represented or implied in the block diagram, the steps may be performed by one element or a plurality of elements. The steps may be performed together or at different times. The elements that perform the activities may be physically the same or proximate one another, or may be physically separate. One element may perform the actions of more than one block. Audio signals may be encoded or not, and may be transmitted in either digital or analog form. Conventional audio signal processing equipment and operations are in some cases omitted from the drawing.

Embodiments of the systems and methods described above comprise computer components and computer-implemented steps that will be apparent to those skilled in the art. For example, it should be understood by one of skill in the art that the computer-implemented steps may be stored as computer-executable instructions on a computer-readable medium such as, for example, floppy disks, hard disks, optical disks, Flash ROMS, nonvolatile ROM, and RAM. Furthermore, it should be understood by one of skill in the art that the computer-executable instructions may be executed on a variety of processors such as, for example, microprocessors, digital signal processors, gate arrays, etc. For ease of exposition, not every step or element of the systems and methods described above is described herein as part of a computer system, but those skilled in the art will recognize that each step or element may have a corresponding computer system or software component. Such computer system and/or software components are therefore enabled by describing their corresponding steps or elements (that is, their functionality), and are within the scope of the disclosure.

A number of implementations have been described. Nevertheless, it will be understood that additional modifications may be made without departing from the scope of the inventive concepts described herein, and, accordingly, other embodiments are within the scope of the following claims.

What is claimed is:

1. A method of operating a binaural hearing assistance system that comprises a binaural hearing device that comprises first and second earpieces, each earpiece adapted to be worn over, on or in one ear, each earpiece comprising an electroacoustic transducer that converts an input electrical audio signal for the ear into sound, and at least one microphone that converts external environmental sound into an electrical microphone output signal, where the binaural hearing assistance system is adapted to use a binaural beamforming microphone algorithm to directionally process microphone output signals from microphones from both earpieces using a digital signal processor to create the electrical audio signals that are used to drive the transducers of both earpieces, to increase speech intelligibility in the presence of noise, the method comprising:

detecting when one of the first and second earpieces is dropped and is no longer over, on or in an ear; and in response to detecting when one of the first and second earpieces is dropped, either:

modifying the binaural beamforming microphone algorithm by turning off a microphone bias of a microphone of the dropped earpiece; or turning off the output of the transducer of the dropped earpiece; or reducing an output level of the transducer of the dropped earpiece.

2. The method of claim 1 wherein modifying the binaural beamforming microphone algorithm comprises processing only the microphone output signal from the other of the first and second earpieces to create the audio signal for the transducer of the other earpiece.

3. The method of claim 1 wherein modifying the binaural beamforming microphone algorithm comprises processing microphone output signals from both earpieces to create the electrical audio signals that are used to drive the transducers of both earpieces, but only up to a cutoff frequency.

4. The method of claim 1 wherein modifying the binaural beamforming microphone algorithm comprises modifying the processing of the microphone output signals from the dropped earpiece.

5. The method of claim 4, further comprising maintaining the processing of the microphone output signals from the other earpiece.

6. The method of claim 4 wherein modifying the processing of the microphone output signals from the dropped earpiece comprises band limiting the microphone output signals from the dropped earpiece.

7. A method of operating a binaural hearing assistance system that comprises a binaural hearing device that comprises first and second earpieces, each earpiece adapted to be worn over, on or in one ear, each earpiece comprising an electroacoustic transducer that converts an input electrical audio signal for the ear into sound, and at least one microphone that converts external environmental sound into an electrical microphone output signal, where the binaural hearing assistance system is adapted to use a binaural beamforming microphone algorithm to directionally process microphone output signals from microphones from both earpieces using a digital signal processor to create the electrical audio signals that are used to drive the transducers of both earpieces, to increase speech intelligibility in the presence of noise, the method comprising:

detecting when one of the first and second earpieces is dropped and is no longer over, on or in an ear; and in response to detecting when one of the first and second earpieces is dropped, modifying the binaural beamforming microphone algorithm by band limiting the microphone output signals from the dropped earpiece, so as to reduce the impact of the dropped earpiece on the binaural hearing assistance system.

8. The method of claim 7 further comprising, in response to detecting when an earpiece is dropped, reducing an output level of the transducer of the dropped earpiece.

9. The method of claim 7 wherein modifying the binaural beamforming microphone algorithm comprises turning off a microphone bias of a microphone of the dropped earpiece.

10. The method of claim 1 wherein the binaural beamforming microphone algorithm a binaural steady-state noise reduction algorithm.

11. The method of claim 10 wherein the binaural steady-state noise reduction algorithm is modified by changing a configuration of internal parameters within the steady-state noise reduction algorithm.

12. The method of claim 1, wherein the binaural hearing assistance system further comprises neckware, and wherein detecting when one of the first and second earpieces is dropped comprises detecting a proximity of the earpiece to the neckware.

13. The method of claim 3, wherein the cutoff frequency is about 500 Hz.

14. The method of claim 7 further comprising, in response to detecting when an earpiece is dropped, turning off the output of the transducer of the dropped earpiece.

* * * * *